US006918233B2

(12) United States Patent
Roy et al.

(10) Patent No.: US 6,918,233 B2
(45) Date of Patent: Jul. 19, 2005

(54) METHOD FOR INSERTING ONE OR MORE CANISTERS INTO A FLEXIBLE POUCH IN A PREDETERMINED ORIENTATION

(75) Inventors: James B. Roy, Ontario, NY (US); John DePoint, Jr., Palmyra, NY (US); Gary E. Merz, Rochester, NY (US); Marion T. Juskiewicz, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/402,458

(22) Filed: Mar. 28, 2003

(65) Prior Publication Data

US 2003/0188515 A1 Oct. 9, 2003

Related U.S. Application Data

(63) Continuation-in-part of application No. 09/844,017, filed on Apr. 27, 2001, now abandoned.

(51) Int. Cl.[7] ..... B65B 35/30

(52) U.S. Cl. ..... 53/448; 53/247; 53/251; 53/469; 53/475; 53/543; 53/570

(58) Field of Search ..... 53/247, 473, 284.7, 53/570, 459, 384.1, 385.1, 443, 467, 469, 475, 480, 481, 448, 543, 250, 251

(56) References Cited

U.S. PATENT DOCUMENTS

| | | | | | |
|---|---|---|---|---|---|
| 2,633,280 | A | | 3/1953 | Davies | 226/14 |
| 3,530,644 | A | | 9/1970 | Kapare | 53/187 |
| 3,592,000 | A | * | 7/1971 | Kapare | 53/448 |
| 3,774,778 | A | * | 11/1973 | Flaig | 414/591 |
| 4,210,249 | A | * | 7/1980 | Holmes | 383/211 |
| 4,514,956 | A | | 5/1985 | Varallo et al. | 53/148 |
| 4,713,926 | A | | 12/1987 | Mennie et al. | 53/443 |
| 4,800,703 | A | * | 1/1989 | Goodman | 53/53 |
| 4,939,891 | A | * | 7/1990 | Podini | 53/496 |
| 5,605,031 | A | * | 2/1997 | Prakken | 53/537 |
| 5,673,540 | A | | 10/1997 | Sanukiya et al. | 53/448 |
| 5,778,640 | A | * | 7/1998 | Prakken et al. | 53/475 |
| 5,782,056 | A | * | 7/1998 | May et al. | 53/138.4 |
| 5,788,378 | A | * | 8/1998 | Thomas | 383/63 |
| 5,802,817 | A | * | 9/1998 | Hood | 53/459 |
| 5,819,509 | A | * | 10/1998 | McGregor et al. | 53/525 |
| 6,021,624 | A | * | 2/2000 | Richison et al. | 53/410 |
| 6,125,615 | A | * | 10/2000 | Germunson et al. | 53/469 |
| 6,209,293 | B1 | | 4/2001 | Powers | 53/475 |
| 6,240,709 | B1 | * | 6/2001 | Cook | 53/469 |
| 2001/0029226 | A1 | * | 10/2001 | Ickikawa et al. | |
| 2002/0121075 | A1 | * | 9/2002 | Schabel et al. | |

FOREIGN PATENT DOCUMENTS

| | | |
|---|---|---|
| NL | 6 813 254 | 3/1970 |

* cited by examiner

*Primary Examiner*—Rinaldi I. Rada
*Assistant Examiner*—Gloria R. Weeks
(74) *Attorney, Agent, or Firm*—Peyton C. Watkins

(57) ABSTRACT

A method for inserting one or more canisters into a flexible pouch includes having the pouch with a re-sealable end portion for permitting insertion of the canisters. The pouch also includes a collapsible and flexible floor portion on which one or more of the canisters are positioned. A side portion encloses the canisters and connects the end portion to the floor portion. The method further comprises positioning the canisters into a position adjacent the pouch, and attaching one or more of the canisters to a mechanical arm for providing transportation to the pouches. The canisters are placed through the re-sealable open end and onto the collapsible and flexible floor portion so that the floor portion forms a stable storage platform for the canisters.

12 Claims, 3 Drawing Sheets

METHOD FOR INSERTING ONE OR MORE CANISTERS INTO A FLEXIBLE POUCH IN A PREDETERMINED ORIENTATION

CROSS-REFERENCE TO RELATED APPLICATIONS

This is a continuation-in-part of abandoned application Ser. No. 09/844,017 filed Apr. 27, 2001, by James Roy et al., and entitled, "A METHOD FOR INSERTING ONE OR MORE CANISTERS INTO A FLEXIBLE POUCH IN A PREDETERMINED ORIENTATION".

FIELD OF THE INVENTION

This invention relates generally to flexible, sealable and re-sealable pouches and, more particularly, to a method for loading canisters into the pouches.

BACKGROUND OF THE INVENTION

Flexible, sealable and re-sealable pouches are commercially used for storing liquids, powders or loose-fill goods such as, for example, snack foods and liquid juices. One reason for using these pouches for these types of items is that they are easily placed in the pouches, with the quantity loaded controlled by either product weight or volume. In other words, the sealable or re-sealable end is simply opened and the liquid or snack foods are simply poured or drop-feed into the pouches and then sealed. These pouches are not used, however, for storing larger, solid items in which a predetermined orientation, such as stacking, side-by-side placement and the like, is needed because of the complexity in inserting these items in the pouch. Such items would have to be manually inserted into the pouches which is not economically feasible.

Although the presently known and utilized method and apparatus for storing items in pouches are satisfactory, they include drawbacks. Inserting solid objects into flexible pouches in a predetermined orientation is difficult and not commercially feasible.

Consequently, a need exists for a method and device for inserting relatively large, solid objects into flexible pouches.

SUMMARY OF THE INVENTION

The present invention is directed to overcoming one or more of the problems set forth above. Briefly summarized, according to one aspect of the present invention, the invention resides in a method for inserting one or more articles of manufacture into a flexible pouch having either a one-time sealable or re-sealable end portion for permitting insertion of the articles of manufacture, a collapsable and flexible floor portion on which one or more of the articles of manufacture are positioned, and a flexible side portion for enclosing the articles of manufacture and connecting the end portion to the floor portion, the method comprising the steps of (a) positioning the one or more articles of manufacture into a position adjacent said pouch; (b) attaching the one or more of articles of manufacture to a mechanical arm for providing transportation to said pouch; and (c) placing the one or more articles of manufacture through the end portion and onto the collapsable and flexible floor portion so that the floor portion forms a stable storage platform for the articles of manufacture.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE INVENTION

Figure 1:
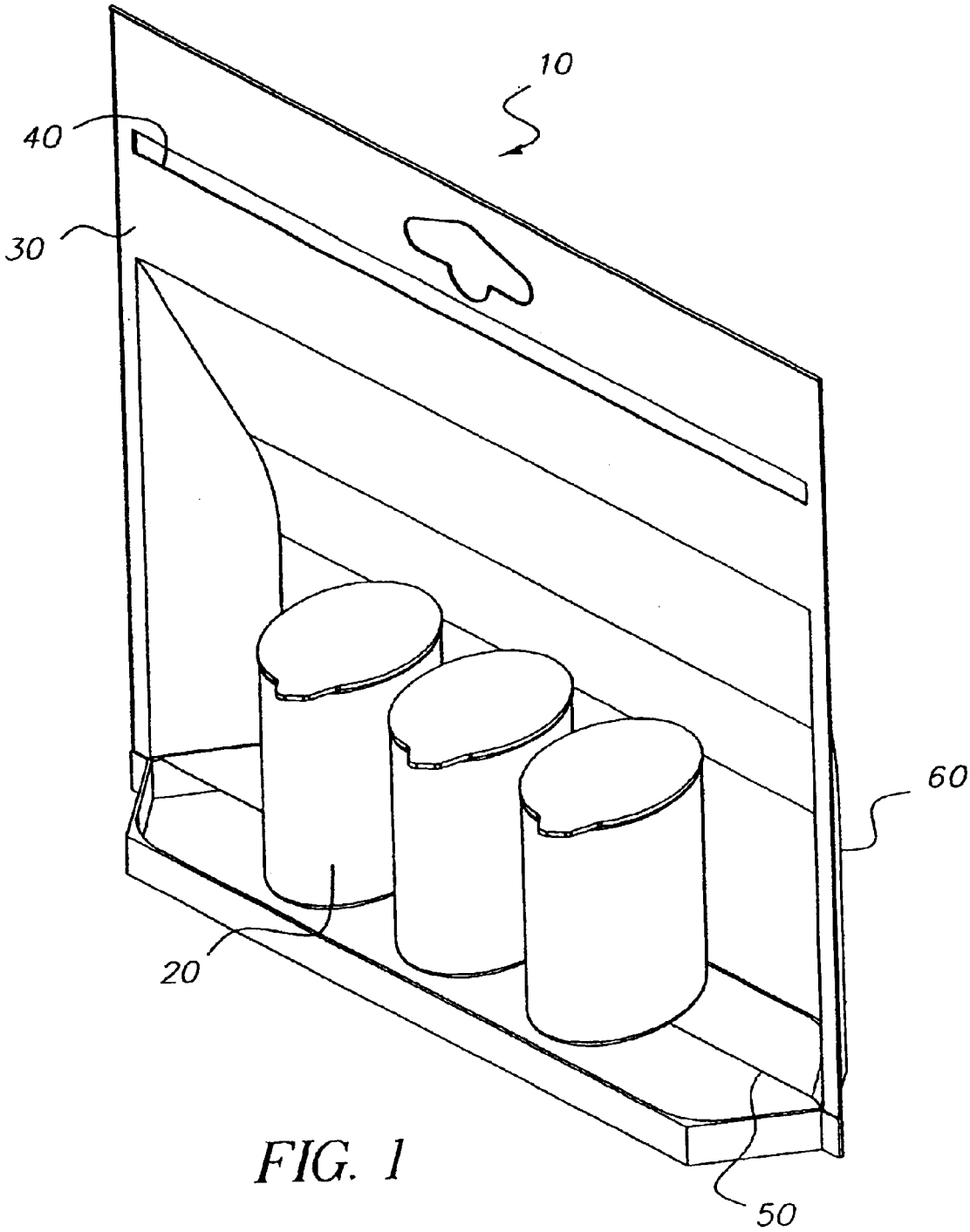
FIG. 1 is a perspective view of a pouch of the present invention with a portion cutaway for showing film canisters stored therein.

In the following description, like reference characters designate like or corresponding parts throughout the several views of the drawings. Also in the following description, it is to be understood that such terms as "forward," "rearward," "left," "right," "upwardly," "downwardly," and the like are words of convenience and are not to be constructed as limiting terms.

Referring to FIG. 1, there is shown a flexible, one-time sealable pouch 10 or a flexible re-sealable pouch 10 for storing film canisters 20 therein, preferably three side-by-side canisters. The canisters 20 are preferably Advance Photo System (APS) canisters, and include APS film (not shown) therein for capturing images thereon when operated with an APS camera. The pouch 10 includes a one-time sealable or re-sealable end portion 30 having a zip type seal 40 which permits opening and sealing, and re-sealing of the end portion 30 in the case of a re-sealable end portion 30, for permitting insertion and retrieval of the film canisters. The zip type seal 40 includes mechanically interlocking portions on opposite sides of the end portion 30 for opening, sealing and re-sealing, each method is well known in the art. The pouch 10 includes a collapsible, flexible bottom-portion 50 which, when the canisters 20 are contained therein, forms a stable platform on which the canisters 20 rest. The bottom portion 50 is collapsible so that, when canisters 20 are not contained therein, it may be collapsed into a more compact configuration. The pouch 10 further includes flexible side portions 60 (the front portion is cutaway for clarity) that attach the bottom portion 50 and end portion 30 together for forming an enclosure for enclosing the canisters 20 therein. The side portions 60 are pushed outwardly into its expanded position when the canisters 20 are inserted therein.

Figure 2:
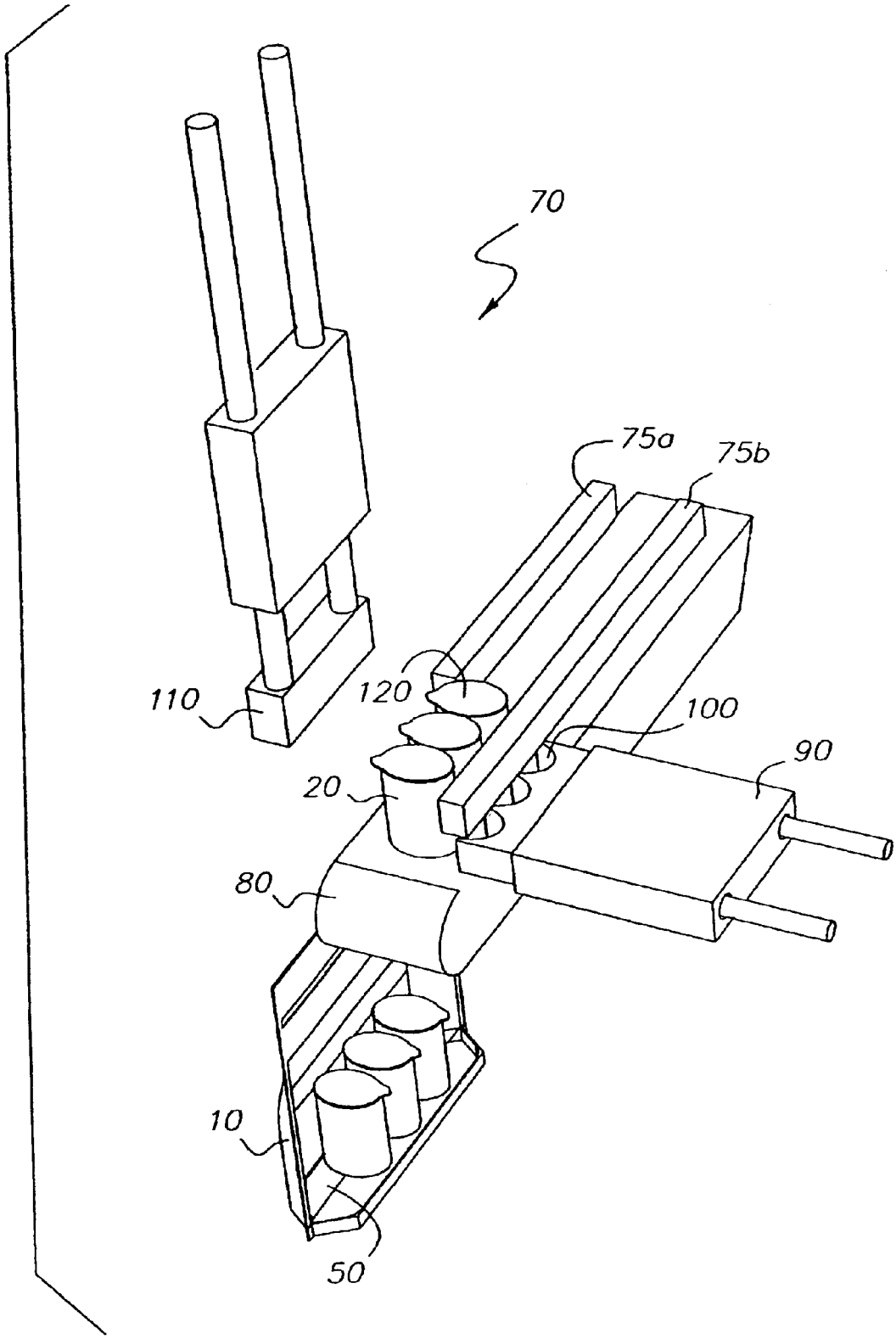
FIG. 2 is a loading mechanism for inserting the canisters into the pouch.

Referring to FIG. 2, there is shown a loading mechanism 70 for inserting the canisters 20 into the pouch 10. The loading mechanism 70 includes a conveyor belt 80 for transporting the canisters 20 into a position adjacent and upwardly over the pouch 10. The canisters 20 are transported a substantially three side-by-side configuration which, in the present invention, matches the capacity of the bottom portion 50 of the pouch 10. Those skilled in the art will recognize that other configurations are also possible given different canister and pouch size. Two rails 75 are positioned upwardly adjacent the conveyor belt for assisting in guiding the canisters 20 along the conveyor belt 80. The rail 75*a* directly upwardly over the pouch 10 does not extend over the pouch 10 to permit positioning the canisters close to the pouch 10, as will become apparent from the discussion below.

The conveyor belt 80 delivers the canisters 20 in a suitable position upwardly and over the pouch 10. With the conveyor belt 80 continuing to move, a movable vacuum device 90 having three arcuate-shaped, cutaway portions 100, into which the canisters mate and respectively fit, moves the canisters 20 across the conveyor belt 80. The movable vacuum device 90 by vacuum force sucks the three side-by-side canisters 20 respectively and matingly into three recessed portions 100. When the canisters 20 are in a position over the pouch 10, a second 10 movable device 110 grips the canisters 20 by well-known means (not shown) by their covers 120. The vacuum is then turned off on the first movable vacuum device 90, releasing the canisters 20 to the second movable device 110 which lowers them into the pouch 10 and onto the bottom portion 50.

Those skilled in the art will recognize that separating the motions of the moveable arm 90 and the vacuum device 110 increases the rate at which the pouches can be loaded.

The vacuum force can be further optimized using either vacuum cups or a vacuum platen. Those skilled in the art will recognize that there are other methods for attaching the canisters to the arm such as by mechanical grippers or magnetism (for ferrous metal parts) and the like. It will also be readily apparent to those skilled in the art that other devices other than canisters may be used in the present invention, such as any article of manufacture as commonly understood in the intellectual property field.

Figure 3A:
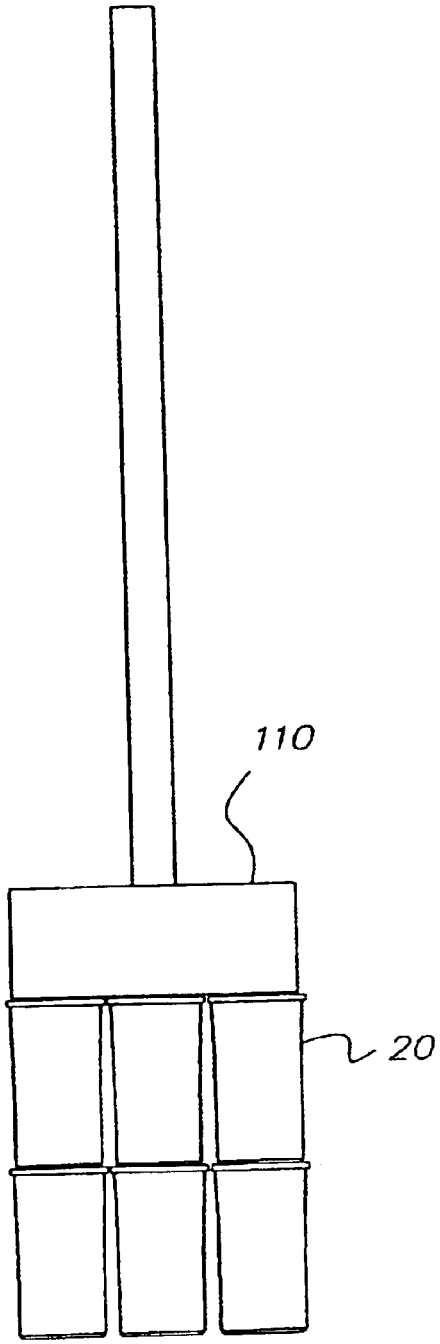
FIGS. 3*a* and 3*b* illustrate alternative orientations and positions of the film canisters in the pouch.

According to the capacity of the pouch 10, this process may be repeated for subsequent pairs of three canisters that are placed upwardly and atop the previous three canisters inserted therein, as shown in FIG. 3*a*.

Figure 3B:
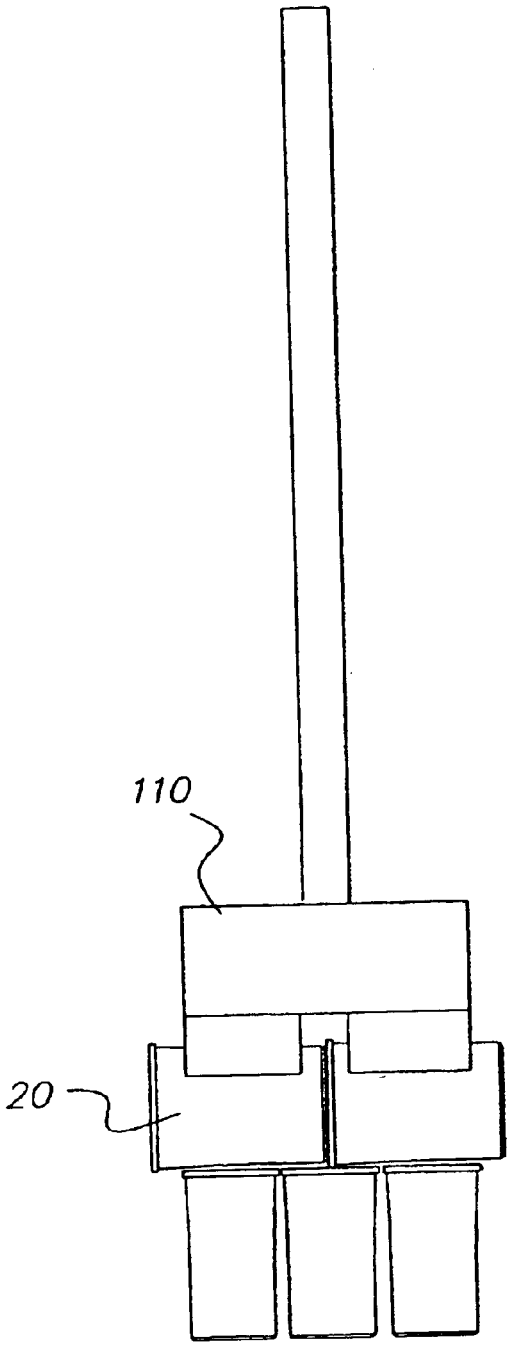

Those skilled in the art will readily recognize that other orientations may be achieved by tooling modification that will be known by those skilled in the art, for example by modifying movable device 110. In FIG. 3*b*, the loading mechanism attaches by vacuum to one pair of two side-by-side canisters. The two side-by-side canisters are placed in a substantially horizontal position on or above the three side-by-side canisters, which are placed in substantially vertical positions. By controlling the positions and orientation of the canister 20 during loading, the size of the pouch can be minimized.

The end portion 30 of the pouch 10 is then closed by a squeezing or tamping motion, both well known in the art.

The flexible side portions and bottom portion both are preferably made of either films, foils or laminated structures of thickness substantially between 75–150 microns (3.5–5.5 Mils). This permits the side walls and floor to be collapsible upon everyday, normal human touching, such touching that is normally associated with picking up small, commercial items from a grocery store and the like. The canisters 20, when inserted into the pouch 10, form a secondary reinforcing portion so that the sidewalls are prevented from collapsing. It is also noted that the canisters 20 are typically elliptical shaped, such as the shape of film canisters.

The invention has been described in detail with particular reference to certain preferred embodiments thereof, but it will be understood that variations and modifications can be effected within the spirit and scope of the invention.

PART LIST

10 flexible, one-time sealable or re-sealable pouch
20 film canisters
30 one-time sealable or re-sealable end portion
40 ziplock seal
50 flexible bottom-portion
60 flexible side portions
70 loading mechanism
75*a* rail
75*b* rail
80 conveyor belt
90 movable vacuum device
100 arcuate-shaped cutaway portions
110 second movable device
120 covers

What is claimed is:

1. A method for inserting one or more articles of manufacture into a flexible pouch having either a one-time sealable or re-sealable end portion for permitting insertion of the articles of manufacture, a collapsible and flexible floor portion on which one or more of the articles of manufacture are positioned, and a flexible side portion for enclosing the articles of manufacture and connecting the end portion to the floor portion, the method comprising the steps of:

(a) providing the flexible pouch with the collapsible and flexible floor portion and flexible side portion; wherein the side walls collapse upon normal human touching;

(b) positioning the one or more articles of manufacture into first and second layers so that the first layer is positioned substantially perpendicular to the second layer adjacent to said pouch;

(c) attaching the one or more of articles of manufacture to a mechanical arm for providing transportation to said pouch; and (d) while the one or more articles of manufacture are attached to the arm, vertically lowering the one or more articles of manufacture through the end portion and onto the collapsible and flexible floor portion so that the floor portion forms a stable storage platform for the articles of manufacture, and the inserted articles of manufacture form a secondary reinforcing portion so that the sidewalls are urged against collapsing, with articles of manufactured inserted into the pouch, upon normal human touching of the pouch; wherein the first layer of the article of manufacture is substantially perpendicular to the second layer of the articles of manufacture when positioned in the pouch.

2. The method as in claim 1, wherein step (c) includes attaching the arm to three canisters aligned substantially side-by-side.

3. The method as in claim 1, wherein step (c) includes attaching the arm to two pairs of three canisters aligned substantially side-by-side.

4. The method as in claim 1, wherein step (c) includes attaching the arm to one pair of two canisters aligned side-by-side and one pair of three canisters aligned substantially side-by-side.

5. The method as in claim 1, wherein step (b) includes positioning the articles of manufacture in a predetermined orientation on a conveyor belt for transporting the articles of manufacture toward the pouch.

6. The method as in claim 5, wherein step (b) includes providing a re-positioning arm for separating a predetermined number of the articles of manufacture.

7. The method as in claim 6, wherein step (b) includes providing a loading device for transporting the articles of manufacture into the pouch.

8. The method as in claim 6, wherein step (b) includes urging the articles of manufacture across the conveyor belt toward the pouch.

9. The method as in claim 6 further comprising providing notched-out portions in the re-positioning arm.

10. The method as in claim 1 further comprising providing canisters as the articles of manufacture.

11. The method as in claim 1 further comprising separating motion of the re-positioning arm from motion of the mechanical arm for providing increased rate at which the pouches can be loaded.

12. The method as in claim 1 further comprising controlling position and orientation of the articles of manufacture during loading for providing a minimum pouch size.

* * * * *